United States Patent [19]

Blin et al.

[11] Patent Number: 5,010,948

[45] Date of Patent: Apr. 30, 1991

[54] DEVICE FOR CONTINUOUSLY CASTING LIQUID METAL BETWEEN TWO ROLLS

[75] Inventors: Philippe Blin; Georges Weber, both of Metz; Jacques Barbe, Saint Etienne, all of France

[73] Assignee: Institut de Recherces de la Siderurgie Francaise "Irsid", Paris, France

[21] Appl. No.: 526,432

[22] Filed: May 22, 1990

[30] Foreign Application Priority Data

May 29, 1989 [FR] France ..... 89 07011

[51] Int. Cl.[5] ..... B22D 11/06

[52] U.S. Cl. ..... 164/428; 164/480

[58] Field of Search ..... 164/428, 480

[56] References Cited

U.S. PATENT DOCUMENTS 4,723,590 2/1988 Yamauchi et al. .

FOREIGN PATENT DOCUMENTS 675811 5/1966 Belgium .
2613646 10/1988 France .
59-50955 3/1984 Japan ..... 164/428
60-166149 8/1985 Japan ..... 164/428

OTHER PUBLICATIONS

Patent Abstracts of Japan, vol. 6, No. 187 (M-158)[1065], 25 Sep. 1982-JP-A 57 94 456 (Kawasaki Seitetsu K. K.) 11-06-1982.

*Primary Examiner*—Kuang Y. Lin
*Attorney, Agent, or Firm*—Cushman, Darby & Cushman

[57] ABSTRACT

The device comprises two parallel horizontal rolls (*2a, 2b*) delimiting therebetween an inserted volume for the liquid metal (1) to be cast, the ends of the volume being closed by plates (4) with a predetermined clearance between the latter and the surfaces of the rolls against which they are maintained. In order to maintain the clearance constant during successive castings, the plates (4) incorporate rolling members (7) bearing against the end surfaces of the rolls (*2a, 2b*) and projecting from surfaces of the plates (4) a distance equal to the desired clearance (e). The plates (4) are biased toward the rolls by springs (10) which bear against a frame (2). The rolling members (7) (rollers and/or balls) avoid any wear of the plates and this clearance is automatically maintained by the action of the springs (10) during the casting operations.

10 Claims, 2 Drawing Sheets

DEVICE FOR CONTINUOUSLY CASTING LIQUID METAL BETWEEN TWO ROLLS

The present invention relates to a device for continuously casting liquid metal comprising two parallel horizontal rolls spaced a predetermined distance apart and delimiting therebetween a space for receiving liquid metal cast in the form of a flat product below the rolls, and plates for closing the ends of said space, disposed against the end surfaces of the rolls or against one end surface of one roll and a part of the cylindrical surface of the other roll if the two rolls are axially offset.

Said plates or lateral walls closing the casting space, commonly termed "small sides", must be maintained in position for casting liquid steel with a clearance of the order of 0.1 mm so as to avoid infiltrations. Now, this clearance varies during the casting as a function of the degree of expansion of the rolls, and in particular of the annular copper sleeves constituting the periphery of the rolls. Consequently, if the clearance in the cold state is excessive for taking into account the expansion phenomenon when bringing the device to the required thermal operating conditions, infiltrations of liquid metal are liable to occur between the closing plates and the rolls. Inversely, a small clearance set in the cold state results in rapid wear of the plates and a friction torque which has an adverse effect on the driving of the rolls so that the plates must be frequently replaced.

An object of the invention is therefore to provide a device in which these drawbacks are avoided.

According to the invention, the casting device comprises rolling members interposed between the closing plates and said surfaces of the rolls for maintaining said initially-set clearance constant during the casting.

According to one embodiment, said rolling members are incorporated in the plates and maintained in bearing relation against the confronting surfaces of the rolls by elastically yieldable elements.

Said rolling members may be balls or rollers whose axes are disposed on the radii of the rolls and which are so dimensioned that the distance between the surfaces of the plates and the confronting surfaces of the rolls is equal to the desired clearance.

The plates and their rolling balls or rollers are biased against the surfaces of the rolls by springs which bear against backing support frames provided for each plate.

Said device for maintaining the clearance requires no supervision or adjustment in the course of the casting as a function of variations in the dimension of the rolls due to expansion, owing to the fact that the clearance is automatically maintained by the thrust springs.

The invention will now be described in detail with reference to two embodiments illustrated in the accompanying drawings and given as non-limitative examples.

Figure 1:
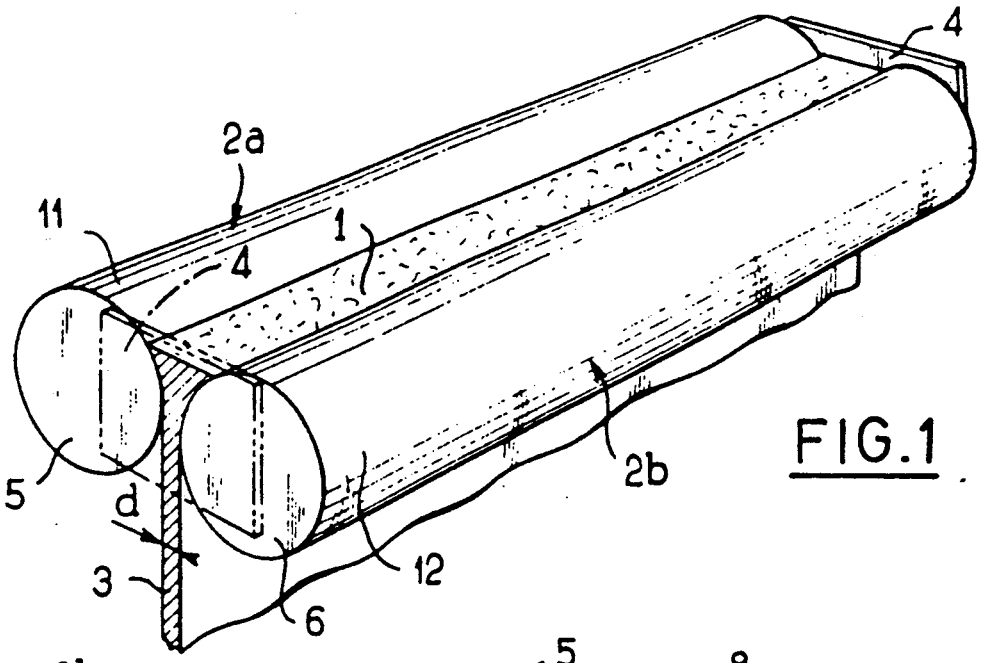
FIG. 1 is a simplified perspective view of a device for continuously casting liquid metal of the type provided by the invention.
Figure 2:
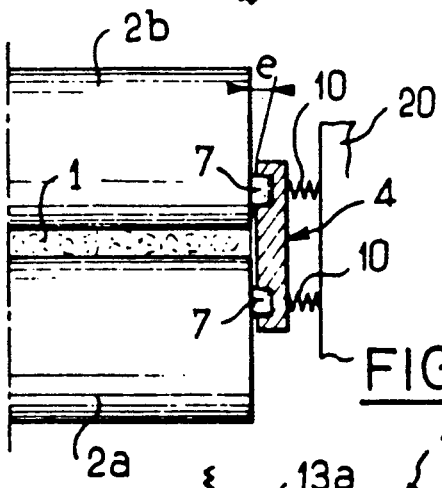
FIG. 2 is a partial top plan view of two of the ends of the rolls of the device of FIG. 1 provided with a plate and rolling members according to the invention.
Figure 3:
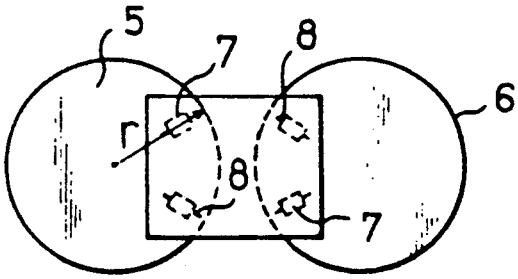
FIG. 3 is an end elevational view of the device of FIG. 2.

The device shown in FIGS. 1 to 3 is to effect a continuous casting from a bath 1 of liquid metal, for example steel, between two parallel horizontal rolls 2*a*, 2*b* spaced apart a predetermined distance d corresponding to the thickness of the solidified flat product 3 which is extracted from below the rolls 2 during the casting. Said device further comprises two end plates 4 for closing the ends of the casting space between the rolls 2.

The plates 4 are located with a predetermined clearance alongside the end surfaces 5, 6 of the rolls 2 which are not axially offset in the presently-described embodiment.

The device is provided with means for maintaining constant during the casting the clearance e between the plates 4 and the end surfaces 5, 6 comprising rolling members incorporated in the plates 4. In the illustrated embodiment, the rolling members are rollers 7 in the minimum number of two per roll 2*a*, 2*b* partly housed within the plate 4 and mounted to be rotatable about axes 8 parallel to radii r of the rolls 2*a*, 2*b*. Preferably, the rollers 7 are positioned in the vicinity of the periphery of the rolls 2*a*, 2*b* so as to bear against the annular sleeves 11, 12 which are for example of copper. The sleeves are respectively provided on the rolls 2*a*, 2*b* and are the parts of the latter which undergo the principal expansion.

The rollers 7 are dimensioned and positioned in the side of the plates 4 facing toward the rolls 2*a*, 2*b* and project from this side so that the distance e between the surfaces of the plates 4 and the respective end surfaces 5, 6 of the rolls is equal to the desired clearance, for example 0.1 mm for casting liquid steel.

Elastically yieldable means comprising springs 10 bearing against a backing support frame 20 exert on the plates 4 thrusts of suitable force sufficient to avoid the rearward movement of the plates 4 under the effect of the pressure exerted on the latter by the metal contained in the casting space. These thrusts are exerted in directions toward the end surfaces 5, 6 of the rolls in order to maintain the rolling members 7 against the respective surface 5, 6.

As a variant, the rollers 7 may be replaced by balls or each plate 4 may be provided with balls for bearing against one roll and rollers for bearing against the other roll.

In this way, irrespective of the variation in the width of the sleeves 11, 12 resulting from their expansion in the course of the casting of the liquid metal 1, the clearance e will be maintained constant at the value which both prevents any infiltration of liquid metal between the plates 4 and the end surfaces 5, 6 of the rolls and avoids substantial wear of the surface of the plates 4.

Figure 4:
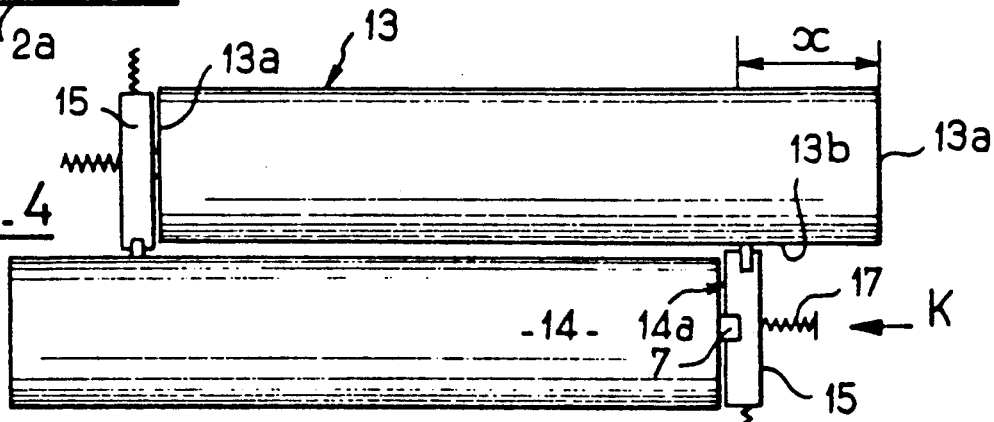
FIG. 4 is a simplified top plan view of a second embodiment of the casting device according to the invention.
Figure 5:
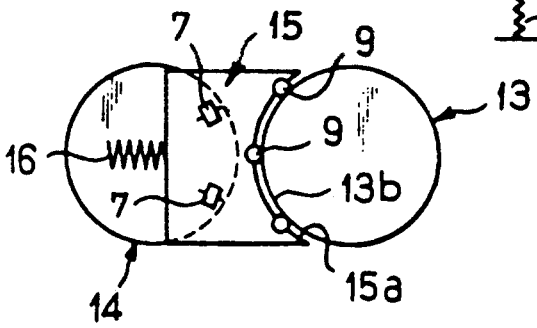
FIG. 5 is an end elevational view in the direction of arrow K of FIG. 4.

The casting device diagrammatically represented in FIGS. 4 and 5 comprises two parallel rolls 13, 14 spaced apart a distance d as in the preceding embodiment, but the rolls are here axially offset a distance x which therefore offsets their respective end surfaces 13*a*, 14*a*.

Correlatively, each plate 15 for closing the end of the casting space between the two rolls 13, 14 has a concave edge 15*a* matching the convex contour of the cylindrical surface 13*b* of the corresponding roll 13, while its planar surface partly covers the associated end surface 14*a* of the roll 14. Each plate 15 is therefore provided with rolling members which bear against the end surface 14*a* and against the cylindrical surface 13*b*, for example the illustrated roller 7 for the surface 14*a* and the balls 9 for the surface 13*b*.

The elastically yieldable means are correspondingly arranged to bias the plates 15 toward the end surface 14*a* and toward the cylindrical surface 13*b*, namely a first spring 16 extending substantially in the plane of each plate 15 and exerting on the edge of the latter remote from the rolling members 9 a force which applies the rolling members against the cylindrical surface 13*b*, and a second spring 17 which is perpendicular to the foregoing spring and to the plate 15 and exerts a force which maintains the rolling members 7 against the surface 14*a*.

The springs 16 and 17 are carried by a support frame (not shown).

Figure 6:
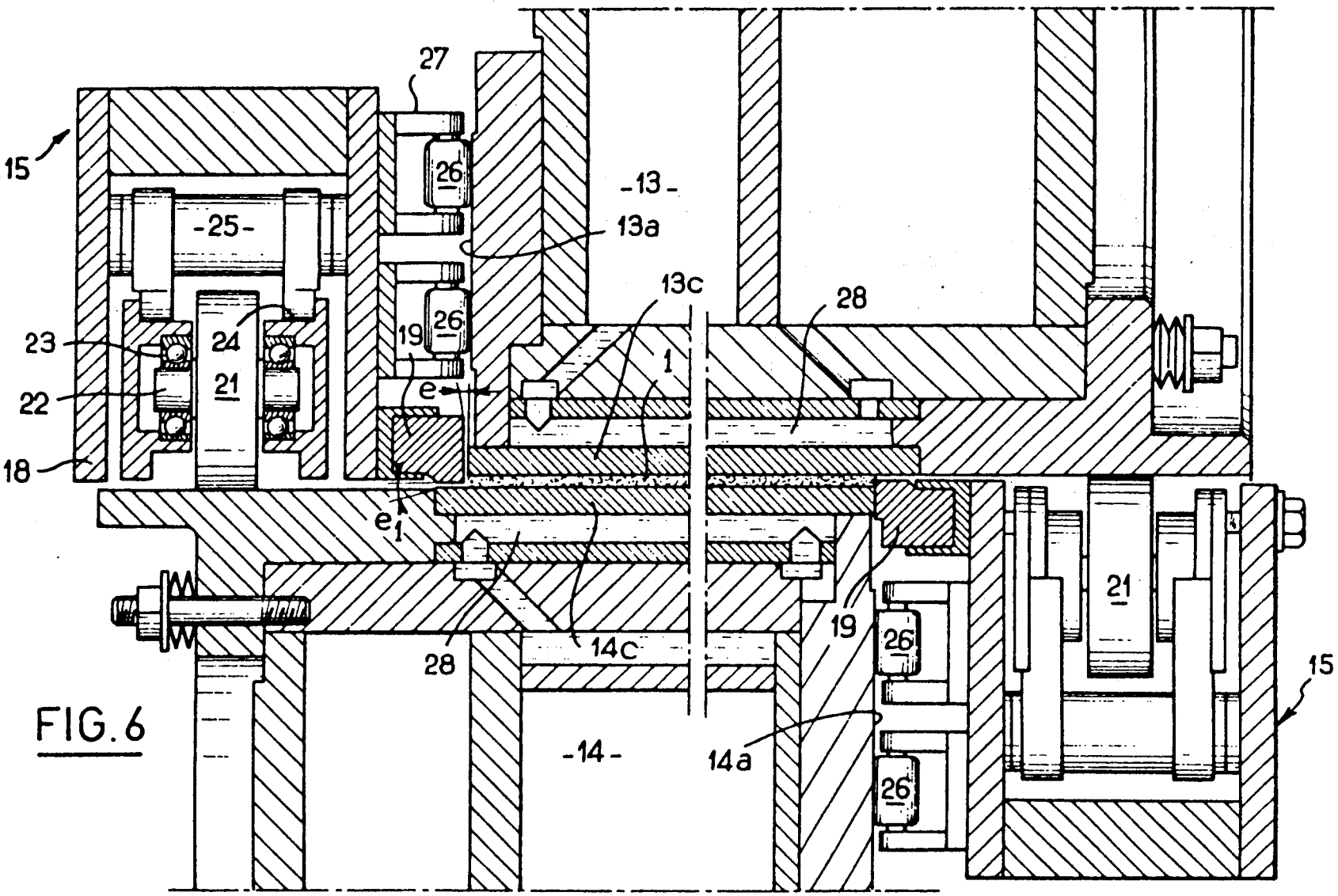
FIG. 6 is a top plan view of an industrial form of the casting device of FIGS. 4 and 5.

The industrial form of the casting device shown in FIG. 6 conforms to that diagrammatically represented in FIGS. 4 and 5. Each plate 15 comprises a U-section frame 18 provided with an element 19 for closing the corresponding end of the casting space containing the liquid metal 1. The frame 18 is open toward the lateral surface of the roll 14 and contains at least two rollers 21 whose journals 22 are journalled in bearings 23 carried by a housing 24 connected to adjusting means 25 which are fixed to the branches of the frame 18. Said adjusting means adjust the initial clearance e1 between the closing element 19 and the sleeve 14*c* of the roll 14.

Each closing plate 15 is additionally equipped with at least two rollers 26 journalled in yokes 27 fixed to each branch of the frame 18 facing toward the corresponding end surface 13*a*, 14*a* of the respective rolls 13 and 14. The rollers 26 have their axes located on radii of the rolls 13 and 14 and the dimensions of the rollers 26 and the yokes 27 are such as to maintain between the closing elements 19 and the sleeves 13*c*, 14*c* of the rolls 13, 14 the desired clearance e. This clearance may moreover be initially adjusted for example by interposing shims between the frame 18 and the closing element 19.

In the known manner, the rolls 13, 14 include cooling passages 28 containing a fluid, for example water.

The rollers 7 and 26 may be replaced by balls such as 9 and the balls 9 may be replaced by rollers. Any other rolling members such as needles may also be employed.

It will be clear that, as the object of the invention is to maintain the clearances e and e1 constant, the raceways of the rolling members must be as far as possible directly connected to the sleeves of the rolls and follow the deformations of the sleeves. For this purpose, the raceways may be formed, as shown in FIG. 6, by attached members corresponding to the end surfaces 13*a*, 14*a* which move with the edges of the sleeve 13*c*, 14*c*, or by a special coating of these edges for avoiding wear of the raceway. The chosen arrangement will depend on the nature, and in particular the hardness, of the alloy constituting the sleeve. It will always be arranged to place the rolling members as close as possible to the outer surface of the sleeves so as to follow the deformations of the latter with the highest possible fidelity.

We claim:

1. Device for continuously casting liquid metal, comprising two parallel horizontal rolls having end surfaces and cylindrical surfaces and spaced a predetermined distance apart and delimiting between the rolls a space for receiving liquid metal cast as a flat product under the rolls, plates for closing ends of said space disposed alongside said end surfaces of the rolls, and rolling members interposed between and in contact with said plates and said end surfaces of the rolls for maintaining a determined clearance between the plates and said end surfaces of the rolls constant during the casting.

2. Device for continuously casting liquid metal, comprising two axially offset parallel horizontal rolls having end surfaces and cylindrical surfaces and spaced apart a predetermined distance and delimiting between the rolls a space for receiving liquid metal cast as a flat product under the rolls, plates for closing ends of said space respectively disposed alongside one end surface of one of said rolls and alongside a part of said cylindrical surface of the other of said rolls, and rolling members interposed between and in contact with said plates and said surfaces of the rolls for maintaining a determined clearance between said surfaces and said plates constant during the casting.

3. Device according to claim 1, wherein said rolling members are incorporated in said plates and elastically yieldable means bias said rolling members against said end surfaces of the rolls through said plates.

4. Device according to claim 2, wherein said rolling members are incorporated in said plates, and elastically yieldable means bias said rolling members against said end surfaces of the rolls through said plates, and elastically yieldable means bias said rolling members against said cylindrical surfaces of the rolls through said plates.

5. Device according to claim 3, wherein said rolling members have rolling axes extending in directions parallel to radii of the rolls, and said device comprises means for maintaining the rolling members in position relative to said plates so that the distance between surfaces of said plates and said end surfaces of the rolls is equal to the desired clearances.

6. Device according to claim 4, wherein said rolling members bearing against said end surfaces of the rolls have rolling axes extending in directions parallel to radii of the rolls, and said device comprises means for maintaining the rolling members in position relative to said plates so that the distance between surfaces of said plates and said end surfaces of the rolls is equal to the desired clearance and the distance between surfaces of said plates and said cylindrical surfaces of the rolls is equal to the desired clearance.

7. Device according to claim 2, wherein each of said plates has a concave edge matching the convex contour of the cylindrical surface of one roll of said rolls and a planar surface partly covering the respective end surface of the other roll of said rolls, each plate being provided with rolling members which bear against the end surface of said one roll and against the cylindrical surface of said other roll, said device comprising elastically yieldable means for biasing each plate toward the respective end surface and toward the respective cylindrical surface.

8. Device according to claim 7, wherein the rolling members bearing against a cylindrical surface are incorporated in a concave edge of the respective plate, and the rolling members bearing against an end surface are incorporated in a surface of the respective plate.

9. Device according to claim 1, wherein said rolling members are selected from the group consisting of balls, rollers and a mixture of balls and rollers.

10. Device according to claim 2, wherein said rolling members are selected from the group consisting of balls, rollers and a mixture of balls and rollers.

* * * * *